US005377367A

United States Patent [19]

Bischoff

[11] Patent Number: 5,377,367

[45] Date of Patent: Jan. 3, 1995

[54] SOAP DISH FOR USE WITH HAND-SHOWER WALL ROD ASSEMBLY

[75] Inventor: Bernd Bischoff, Hemer, Germany

[73] Assignee: Friedrich Grohe Aktiengesellschaft, Hemer, Germany

[21] Appl. No.: 124,270

[22] Filed: Sep. 20, 1993

[30] Foreign Application Priority Data

Nov. 9, 1992 [DE] Germany ..... 4237738

[51] Int. Cl.[6] ..... A47K 5/03

[52] U.S. Cl. ..... 4/605; 4/559; 248/309.1

[58] Field of Search ..... 4/559, 605; 248/214, 248/309.1; 206/77.1

[56] References Cited

U.S. PATENT DOCUMENTS 3,059,374 10/1962 Bernay .
3,266,764 8/1966 Briles .
3,837,013 9/1974 Davis .
4,998,836 3/1991 Scripnick .
5,255,401 10/1993 Sambrookes et al. ..... 4/605

FOREIGN PATENT DOCUMENTS 9016094 3/1991 Germany .

*Primary Examiner*—Charles E. Phillips
*Attorney, Agent, or Firm*—Herbert Dubno; Andrew Wilford

[57] ABSTRACT

A hand-shower wall rod has vertically spaced and horizontally extending upper and lower brackets secured to a wall and a vertical tube with upper and lower ends respectively seated in the brackets. A soap-dish fixture has a body having a lower end formed as a soap dish and an upper end formed as an eye engaged around the lower bracket. The body is swivelable about a horizontal central axis of the lower bracket. A spring unit releasably holds the body in a normal position with the lower end below the lower bracket.

10 Claims, 3 Drawing Sheets

SOAP DISH FOR USE WITH HAND-SHOWER WALL ROD ASSEMBLY

FIELD OF THE INVENTION

The present invention relates to a soap dish. More particularly this invention concerns an accessory usable primarily as a soap dish and carried on a wall rod used for holding a hand shower.

BACKGROUND OF THE INVENTION

A standard wall rod for a hand shower comprises upper and lower brackets that are fixed to the vertical wall of the tub or shower enclosure, a vertical rod with upper and lower ends seated in the respective brackets, and a holder that can slide along and be secured at any location to the rod. The brackets are typically cylindrical, centered on horizontal axes, and of somewhat greater diameter than the rod which is also cylindrical but, of course, centered on an upright axis. The support has a fork or seat formation into which the hose end of the hand shower can be fitted to hold the shower at the desired height so it can be used like a stationary shower.

It is standard to provide an auxiliary soap dish, which may also serve to hold other bath accessories, on such a wall-rod assembly. Such a soap dish is typically a fairly flimsy structure that is easily damaged in use. Furthermore the known soap dishes for use with a hand-shower wall rod often are very difficult to clean and even make it hard to clean the wall behind them.

OBJECTS OF THE INVENTION

It is therefore an object of the present invention to provide an improved soap dish for a hand-shower wall rod assembly.

Another object is the provision of such an improved soap dish for a hand-shower wall rod assembly which overcomes the above-given disadvantages, that is which is very robust, easy to clean, and that does not interfere with cleaning the wall behind it.

SUMMARY OF THE INVENTION

The instant invention is used in combination with a hand-shower wall rod having vertically spaced and horizontally extending upper and lower brackets secured to a wall and a vertical tube with upper and lower ends respectively seated in the brackets. The invention is a soap-dish fixture having a body having a lower end formed as a soap dish and an upper end formed as an eye engaged around the lower bracket. The body is swivelable about a horizontal central axis of the lower bracket. A spring unit releasably holds the body in a normal position with the lower end below the lower bracket.

Thus the soap dish, which term here is not limited to a single-purpose device but also covers a hook or other similar structure, is extremely solidly suspended on the lower bracket. It can nonetheless be swiveled out of the way to clean the wall behind it.

According to a feature of the invention the lower bracket has a cylindrical outer surface between the wall and the rod and the eye is engaged around this surface. Furthermore the spring unit is an axially compressible spring ring engaged around the lower bracket between the eye and the tube and compressed between the tube and the eye to press the body against the wall. The eye is provided with formations rotationally coupling the spring ring to the body. The ring itself is formed with an axially forwardly directed concave seat complementary to and engageable partially around the tube in the normal position of the body.

In accordance with this invention the eye is formed with radially inwardly directed ribs having inner edges riding on the outer surface of the lower bracket. These formations include a radially inwardly generally circumferential rib lying generally in a plane perpendicular to the axis and having secantal sections elastically engaging the outer surface of the lower bracket, radially inwardly projecting ribs extending axially toward the wall from the circumferential rib and having inner edges radially engaging the outer surface of the lower bracket, and radially inwardly projecting front ribs extending axially away from the circumferential rib. The spring ring is formed with radially outwardly open seats in which the front ribs engage to rotationally couple the eye to the spring ring. Thus the spring ring is actually mainly recessed in the front end of the eye, between the circumferential rib and the tube so that it presents a very neat appearance. The spring ring engages resiliently backward against the rib and has in a region diametrally opposite the seat a hook formation engaging thereover and inhibiting axial movement of this region of the spring ring away from the wall. Furthermore the spring ring is integrally formed with angled resilient fingers engaging axially backward against the circumferential rib. This structure is extremely easy to manufacture, durable, and easy to assemble.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
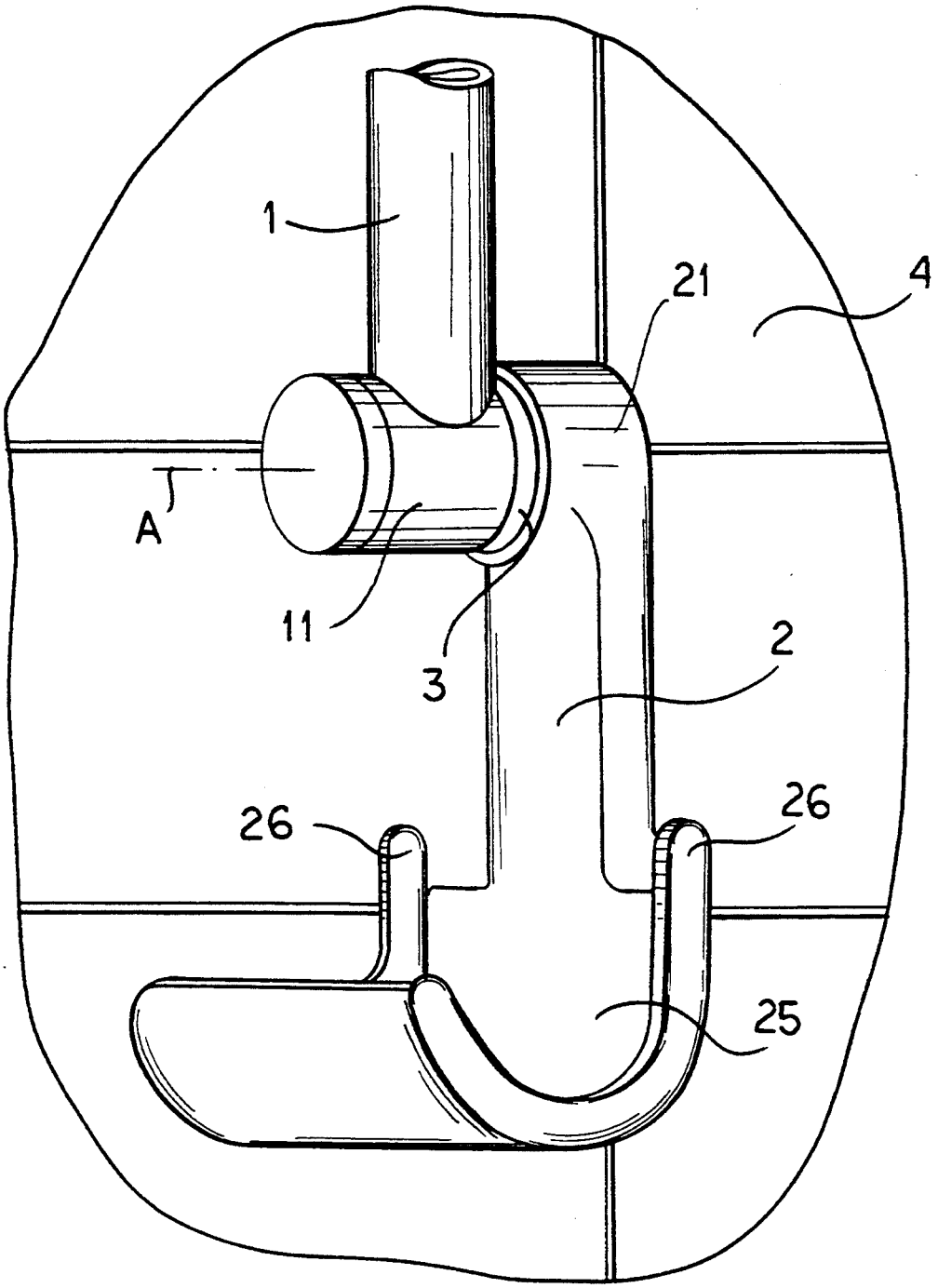
FIG. 1 is a perspective view of the soap-dish assembly according to the invention.

As seen in FIG. 1 a wall-rod assembly comprises vertically spaced brackets 11 (only the lower one shown) secured to a vertical wall 4 and a vertical rod 1 whose ends are seated in the brackets 11. These brackets 11 are cylindrical and centered on horizontal axes A. The rod 1 is spaced horizontally a short distance from the wall 4 that it runs parallel to. Not illustrated are a hand shower and a support that can slide along the rod and hold this hand shower at any desired level between the brackets 11.

According to the invention a soap-dish fixture 2 is suspended from the lower bracket. It has an upper end formed as a cylindrically tubular eye 21 surrounding and coaxial with the bracket 11 and a lower end formed as a soap dish 25 having a pair of end walls 26 extended upward as hooks. The dish 25 is formed with drain grooves 27 so water trapped in it will pass through. A cylindrically tubular spring ring 3 is braced axially between the eye 21 and the rod 1, pressing the planar back face of the dish 2 back flatly against the wall 4.

Figure 2:
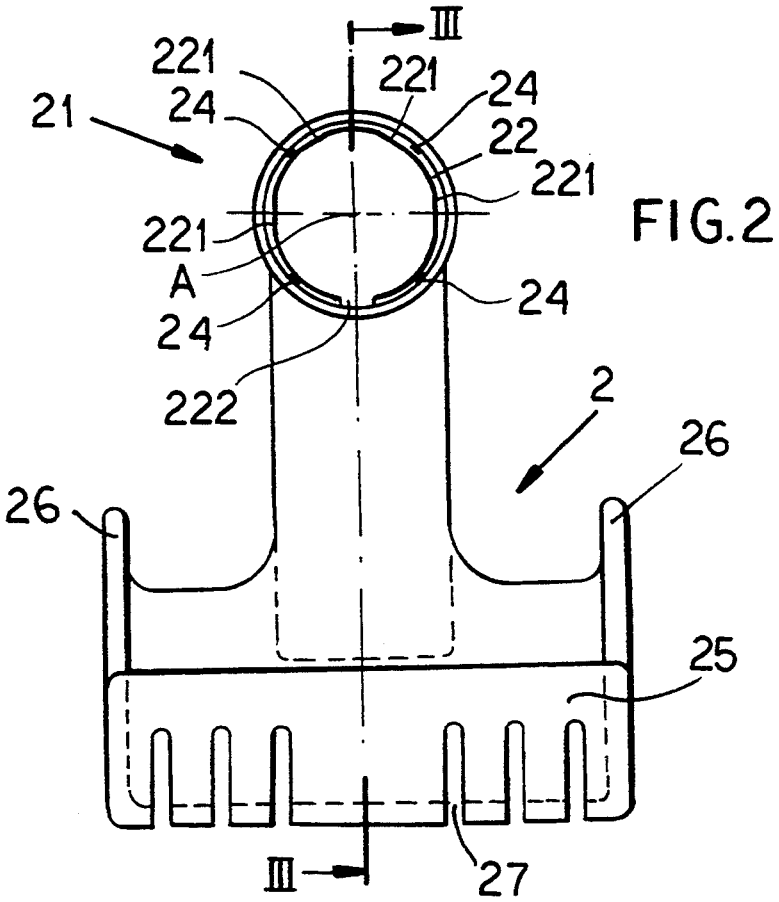
FIG. 2 is a front view of the soap dish of the assembly.
Figure 3:
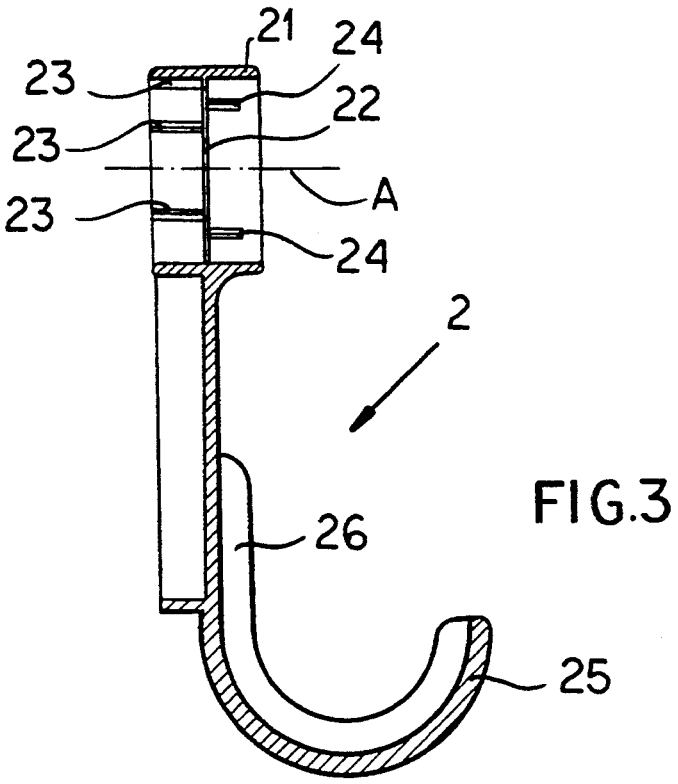
FIG. 3 is a vertical section taken along line III—III of FIG. 2.

As seen in FIGS. 2 and 3 the eye 21 is formed internally with a radially inwardly projecting central planar rib 22 having an inner periphery of a diameter equal to at most slightly more than the outside diameter of the bracket 11 and formed with secantal flats or facets 221 that ensure a snug fit of the eye 21 on the bracket 11. Further radially inwardly projecting and axially extending ribs 23 extend backward toward the wall 4 from the rib 22 and have inner edges that normally ride on the cylindrical outer surface of the bracket 11 to support the dish 2 and keep the eye 21 coaxial with the bracket 11. Forward of the circumferential central rib 22 the eye 21 is formed with four short radially inwardly projecting and axially forwardly extending ribs 24 that engage in complementary outwardly open and axially extending pockets 32 formed in the spring 3 to rotationally couple the spring 3 to the eye 21.

Figure 4:
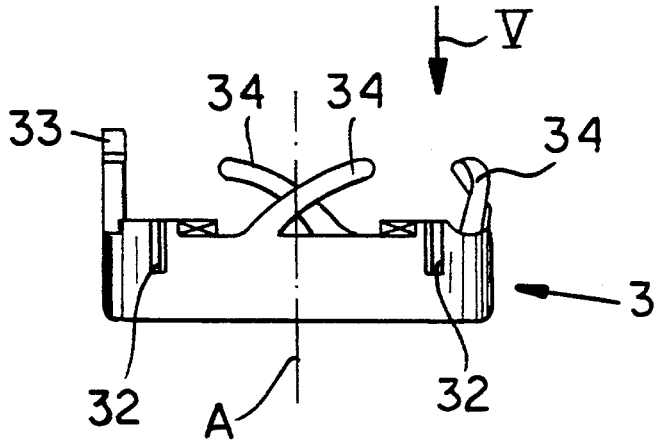
FIG. 4 is a side view of the spring ring of this invention.
Figure 5:
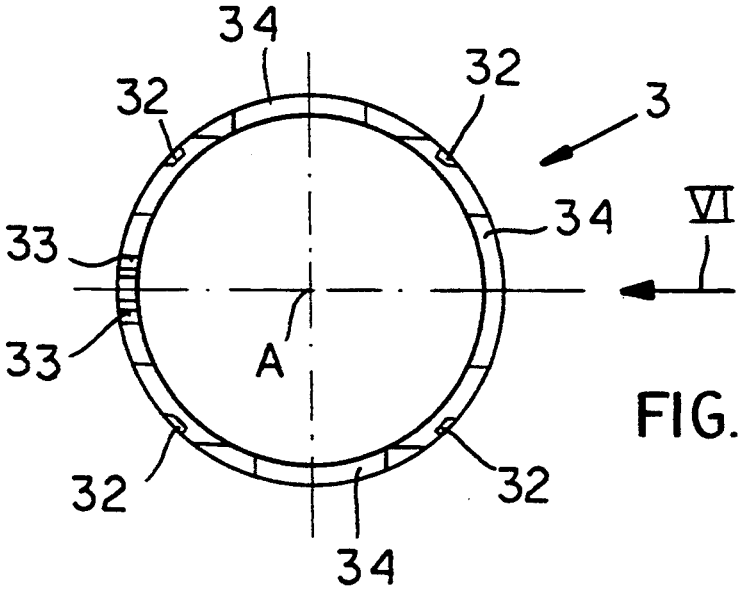
FIG. 5 is a view taken in the direction of arrow V of FIG. 4.
Figure 6:
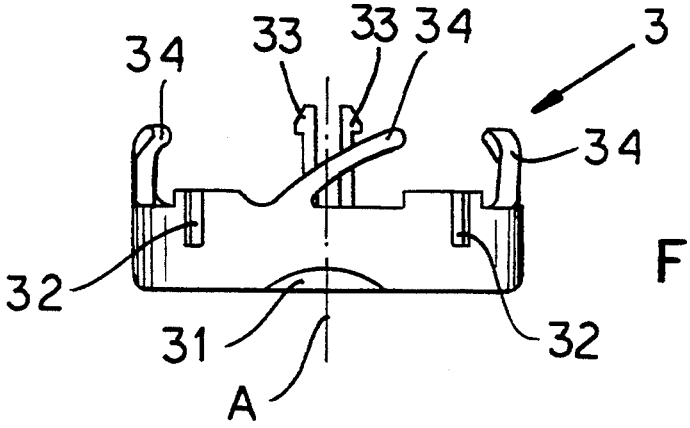
FIG. 6 is a view taken in the direction of arrow VI of FIG. 5.

This spring ring 3 shown in detail in FIG. 4 through 6 is formed with three rearwardly projecting angled spring fingers 34 that are spaced by 90° and bear resiliently against the central rib 22 of the eye 21 to urge the spring 3 forward against the rod 21. In addition the spring 3 is provided with a pair of rearwardly projecting barbed fingers 33 that engage through a notch 222 formed in lowermost region of the rib 22 to hook behind it. On its front face at a location 180° offset from the fingers 33, that is at the top, the spring ring 3 is formed with an axially forwardly open part-cylindrical cutout or seat 31 (see FIG. 6) shaped to fit complementarily to the rod 1.

Thus under normal circumstances the cutout 31 will fit over the rear surface of the rod 1 and the three spring fingers 34 will push the fixture 2 back against the wall 4. Tipping of the spring ring 3 is inhibited by the fingers 33 which prevent the lower portion of this ring 3 from moving axially forward too far relative to the rib 22.

If desired the fixture 2 can be pushed forcible to the side, rotating it about the axis A, so that the ring 3 is forced back with elastic deformation of the fingers 34 to allow the wall behind the fixture 2 to be cleaned. The spring force of the fingers 34 is sufficient to retain the body 2 in any position it is moved to, even sticking out to the side, although of course the system is only positively retained in the illustrated downwardly projecting normal position.

The assembly is very robust since it hangs solidly on the lower bracket 11 and lies flat against the wall. The spring ring 3 holds it in the normal illustrated position so that it does not swivel easily, making it easy to hook something on it, but the ring 3 still permits it to be moved out of the way for cleaning purposes.

I claim:

1. In combination with a hand-shower wall rod having vertically spaced and horizontally extending upper and lower brackets secured to a wall and a vertical tube with upper and lower ends respectively seated in the brackets, the lower bracket having a cylindrical outer surface between the wall and the rod, a soap-dish fixture comprising:

a body having a lower end formed as a soap dish and an upper end formed as an eye engaged around the surface of the lower bracket, the body being swivelable about a horizontal central axis of the lower bracket;

means for releasably holding the body in a normal position with the lower end below the lower bracket; and an axially compressible spring ring engaged around the lower bracket between the eye and the tube and compressed between the tube and the eye to press the body against the wall, the eye being provided with formations rotationally coupling the spring ring to the body.

2. The combination defined in claim 1 wherein the ring is formed with an axially forwardly directed concave seat complementary to and engageable partially around the tube in the normal position of the body.

3. The combination defined in claim 2 wherein the eye is formed with radially inwardly directed ribs having inner edges riding on the outer surface of the lower bracket.

4. The combination defined in claim 2 wherein the eye is formed with a radially inwardly generally circumferential rib lying generally in a plane perpendicular to the axis and having secantal sections elastically engaging the outer surface of the lower bracket.

5. The combination defined in claim 2 wherein the eye is formed with a radially inwardly generally circumferential rib lying generally in a plane perpendicular to the axis and having an inner edge radially engaging the outer surface of the lower bracket and with radially inwardly projecting ribs extending axially toward the wall from the circumferential rib and having inner edges radially engaging the outer surface of the lower bracket.

6. The combination defined in claim 2 wherein the eye is formed with a radially inwardly generally circumferential rib lying generally in a plane perpendicular to the axis and having an inner edge radially engaging the outer surface of the lower bracket and with radially inwardly projecting front ribs extending axially away from the circumferential rib, the spring ring being formed with radially outwardly open seats in which the front ribs engage to rotationally couple the eye to the spring ring.

7. The combination defined in claim 2 wherein the eye is formed with a radially inwardly generally circumferential rib lying generally in a plane perpendicular to the axis and having an inner edge radially engaging the outer surface of the lower bracket, the spring ring engaging resiliently backward against the rib and having in a region diametrally opposite the seat a hook formation engaging thereover and inhibiting axial movement of the region of the spring ring away from the wall.

8. The combination defined in claim 7 wherein the spring ring is integrally formed with angled resilient fingers engaging axially backward against the circumferential rib.

9. The combination defined in claim 7 wherein the spring ring is compressed with sufficient axial force between the tube and eye that the body is retained by spring force in any position angularly offset from the normal position.

10. In combination with a hand-shower wall rod having vertically spaced and horizontally extending upper and lower brackets having cylindrical outer surfaces and secured to a wall and a vertical tube with upper and lower ends respectively seated in the brackets, a soap-dish fixture comprising:

a body having a lower end formed as a soap dish and an upper end formed as a cylindrically tubular eye engaged coaxially around the lower bracket, the body being swivelable about a horizontal central axis of the lower bracket;

a spring ring compressed axially between the eye and the tube and formed with an axially forwardly open concave seat engageable complementarily with the tube in a normal position of the body with the lower end below the lower bracket; and formations in the eye rotationally coupling the spring ring to the eye.

* * * * *